US006339853B1

(12) United States Patent
Apostolo

(10) Patent No.: US 6,339,853 B1
(45) Date of Patent: Jan. 22, 2002

(54) COMBINATION HYDROTHERMAL BATH AND BIDET

(76) Inventor: Mauricio C. Apostolo, 11377 SW. 84th La., Miami, FL (US) 33173

( * ) Notice: Subject to any disclaimer, the term of this patent is extended or adjusted under 35 U.S.C. 154(b) by 0 days.

(21) Appl. No.: 09/737,497

(22) Filed: Dec. 15, 2000

Related U.S. Application Data

(60) Provisional application No. 60/173,267, filed on Dec. 28, 1999.

(51) Int. Cl.[7] ..... A47K 3/22; E03C 1/20

(52) U.S. Cl. ..... 4/444; 4/446

(58) Field of Search ..... 4/443, 444, 446, 4/447, 420, 567–569, 605, 611; D23/295

(56) References Cited

U.S. PATENT DOCUMENTS

| | | | | | |
|---|---|---|---|---|---|
| 205,490 | A | * | 7/1878 | Kuessner et al. | 4/446 |
| 1,369,283 | A | * | 2/1921 | Kelly et al. | 4/446 |
| 1,676,116 | A | * | 7/1928 | Smith | 4/444 |
| 4,145,767 | A | | 3/1979 | Ibel | 4/6 |
| D288,588 | S | | 3/1987 | Stairs, Jr. | D23/51 |
| D310,558 | S | | 9/1990 | Kohler, Jr. et al. | D23/295 |
| D325,248 | S | | 4/1992 | McKeone | D23/295 |
| D326,315 | S | | 5/1992 | Waldren | D23/295 |
| D332,137 | S | | 12/1992 | Kohler, Jr. et al. | D23/295 |
| D337,380 | S | | 7/1993 | Stainton | D23/295 |
| D353,658 | S | | 12/1994 | McKeone et al. | D23/295 |
| D355,025 | S | | 1/1995 | Kohler, Jr. et al. | D23/295 |
| D355,963 | S | | 2/1995 | Formgren et al. | D23/277 |
| D365,144 | S | | 12/1995 | Gruber et al. | D23/277 |
| 5,581,825 | A | * | 12/1996 | Honsvald | 4/444 |
| D378,777 | S | | 4/1997 | Hohenthaner | D23/295 |
| D379,852 | S | | 6/1997 | Eeckhoudt | D23/277 |
| D387,140 | S | | 12/1997 | Laguera Garza | D23/295 |
| D388,159 | S | | 12/1997 | Laguera Garza | D23/295 |
| D398,383 | S | | 9/1998 | Kergoet | D23/295 |
| D404,805 | S | | 1/1999 | Hurt | D23/280.2 |
| 5,920,923 | A | * | 7/1999 | Jillette | 4/541.1 |
| 5,930,851 | A | | 8/1999 | Brunelle | 4/541.1 |

* cited by examiner

*Primary Examiner*—Gregory L. Huson
*Assistant Examiner*—Tuan Nguyen
(74) *Attorney, Agent, or Firm*—Richard L. Miller

(57) ABSTRACT

A combination hydrothermal bath and bidet that is one-piece, made of porcelain, and has a base portion, a front portion, a rear portion, a pair of side portions, and a seat portion. The base portion rests on a floor. The front portion extends upwardly from the base portion. The back portion extends upwardly from the base portion and is leaned against by the back of the user when the combination is utilized as a hydrothermal bath. The pair of side portions extend upwardly from the base portion and forwardly from the back portion to the front portion and are straddled by the legs of the user. The seat portion is sat upon by the user when the combination is utilized as the hydrothermal bath, and is bordered by the base portion, the front portion, the rear portion, and the pair of side portions.

51 Claims, 2 Drawing Sheets

COMBINATION HYDROTHERMAL BATH AND BIDET

CROSS REFERENCE TO RELATED APPLICATIONS

The instant application is a formal application of U.S. provisional application No. 60/173,267, filed on Dec. 28, 1999, and entitled COMBINATION SITZ BATH-BIDET APPARATUS, and it is respectfully requested that this application be accorded the benefit under 35 USC 119(e) of said U.S. provisional application.

BACKGROUND OF THE INVENTION

1. Field of the Invention

The present invention relates to hydrothermal baths and bidets. More particularly, the present invention relates to a combination hydrothermal bath and bidet.

2. Description of the Prior Art

Numerous innovations for bath and bidets have been provided in the prior art that will be described. Even though these innovations may be suitable for the specific individual purposes to which they address, however, they differ from the present invention.

A FIRST EXAMPLE, U.S. Pat. No. Des. 288,588 to Stairs Jr. teaches the ornamental design for a bidet.

A SECOND EXAMPLE, U.S. Pat. No. Des. 310,558 to Kohler Jr. et al. teaches the ornamental design for a bidet.

A THIRD EXAMPLE, U.S. Pat. No. Des. 325,248 to McKeone teaches the ornamental design for a bidet.

A FOURTH EXAMPLE, U.S. Pat. No. Des. 326,315 to Waldren teaches the ornamental design for a bidet.

A FIFTH EXAMPLE. U.S. Pat. No. Des. 332,137 to Kohler Jr. et al. teaches the ornamental design for a bidet.

A SIXTH EXAMPLE, U.S. Pat. No. Des. 337,380 to Stainton teaches the ornamental design for a bidet and the like.

A SEVENTH EXAMPLE, U.S. Pat. No. Des. 353,658 to McKeone et al. teaches the ornamental design for a bidet.

AN EIGHTH EXAMPLE, U.S. Pat. No. Des. 355,025 to Kohler Jr. et al. teaches the ornamental design for a bidet.

A NINTH EXAMPLE, U.S. Pat. No. Des. 355,963 to Formgren et al. teaches the ornamental design for a bathtub.

A TENTH EXAMPLE, U.S. Pat. No. Des. 365,144 to Gruber et al. teaches the ornamental design for a hydromassage bath tub.

A ELEVENTH EXAMPLE, U.S. Pat. No. Des. 378,777 to Hohenthaner teaches the ornamental design for a bidet.

A TWELFTH EXAMPLE, U.S. Pat. No. Des. 379,852 to Eeckhoudt teaches the ornamental design for a bath tub.

A THIRTEENTH EXAMPLE, U.S. Pat. No. Des. 387,140 to Laguera Garza teaches the ornamental design for a bidet.

A FOURTEENTH EXAMPLE, U.S. Pat. No. Des. 388,159 to Laguera Garza teaches the ornamental design for a bidet.

A FIFTEENTH EXAMPLE, U.S. Pat. No. Des. 398,383 to Kergoet teaches the ornamental design for a bidet.

A SIXTEENTH EXAMPLE. U.S. Pat. No. Des. 404,805 to Hurt teaches the ornamental design for a bath tub.

A SEVENTEENTH EXAMPLE, U.S. Pat. No. 4,145,767 to Ibel teaches a composite water closet and bidet that includes a bowl defining a water basin having a rear edge portion on which a storage tank is positioned, in fluid communication with the water basin. A toilet set having an opening therein is pivotally mounted on the bowl to provide a seating surface on the rim of the bowl. A bidet basin is pivotally mounted on the bowl above the seat and has a peripheral seating flange overlying the seating surface of the toilet seat as well as a basin portion which extends through the opening of the toilet seat into the water basin of the bowl. The bowl rim, toilet seat, and bidet have a generally complementary peripheral configuration to provide a uniform and neat appearance, as well as comfortable seating. The water tank has a front surface which includes a bulbous portion formed therein that is generally complementary to a portion of the basin of the bidet whereby the bulbous portion of the tank is received in the bidet basin, when the bidet basin is pivoted upwardly towards the tank, to expose the toilet seat and provide a compact storage configuration for the raised bidet basin.

A EIGHTEENTH EXAMPLE. U.S. Pat. No. 5,930,851 to Brunelle teaches a hydro-thermo massaging tub and method of massage treatment wherein the treatment is performed by warm air jets distributed adjacent the bottom wall of the tub all about its circumference. Air jets are formed by holes made in the tub wall with the longitudinal axis of the holes oriented loss than 45 degrees from the plane of the bottom wall. The jets communicate with an air distribution duct which is fed hot air under pressure by a blower. Controls are also provided to vary the pressure of the air as well as the temperature thereof. Warm air jets are released in the water contained within the tub to impart turbulence in the body of water to create acupressure massaging flows of warm air jets and water flows from opposed sidewalls and end walls of the tub towards a central area of least turbulence which is occupied by the body of a person. The acupressure massaging flows perform a massaging action all about the body simultaneously. The tub also includes a back massaging cavity to simultaneously massage the back. Hot air circulating in the distribution duct also beats the neck and back portion of the tub where the neck and back of the bather rests during treatment.

It is apparent that numerous innovations for baths and bidets have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a combination hydrothermal bath and bidet that avoids the disadvantages of the prior art.

ANOTHER OBJECT of the present invention is to provide a combination hydrothermal bath and bidet that is simple and inexpensive to manufacture STILL ANOTHER OBJECT of the present invention is to provide a combination hydrothermal bath and bidet that is simple to use.

BRIEFLY STATED, STILL YET ANOTHER OBJECT of the present invention is to provide a combination hydrothermal bath and bidet that is one-piece, made of porcelain, and has a base portion, a front portion, a rear portion, a pair of side portions, and a seat portion The base portion rests on a floor The front portion extends upwardly from the base portion The back portion extends upwardly from the base portion and is leaned against by the back of the user when the combination is utilized as a hydrothermal bath. The pair of side portions extend upwardly from the base portion and forwardly from the back portion to the front portion and are straddled by the legs of the user The seat portion is sat upon by the user when the combination is utilized as the hydrothermal bath, and is bordered by the base portion, the front portion, the rear portion, and the pair of side portions.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
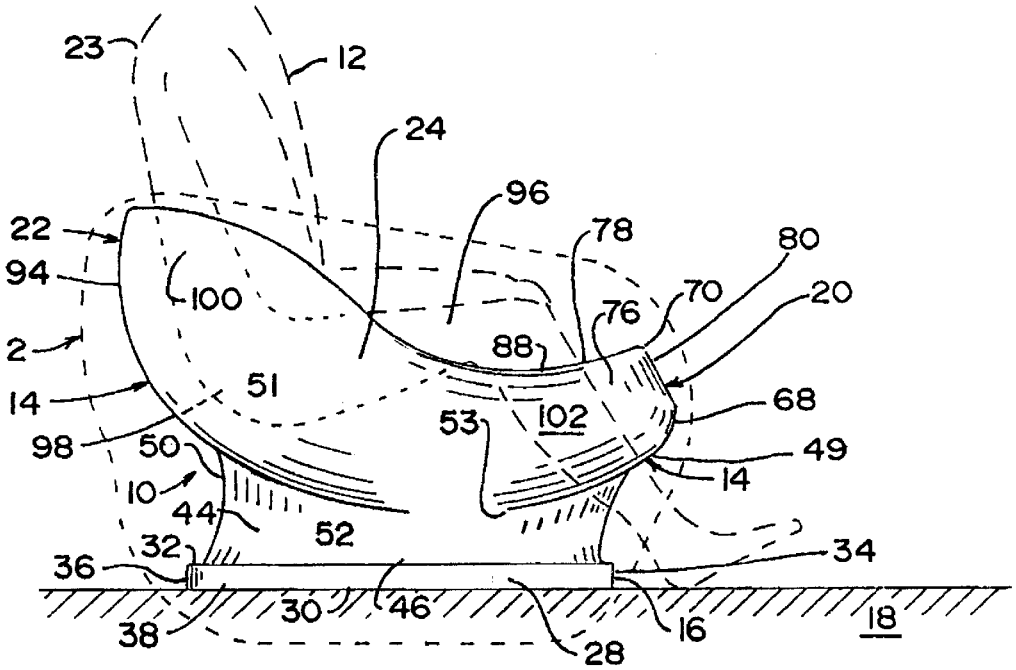
FIG. 1 is a diagrammatic side elevational view of the present invention in use as a hydrothermal bath.
Figure 5:
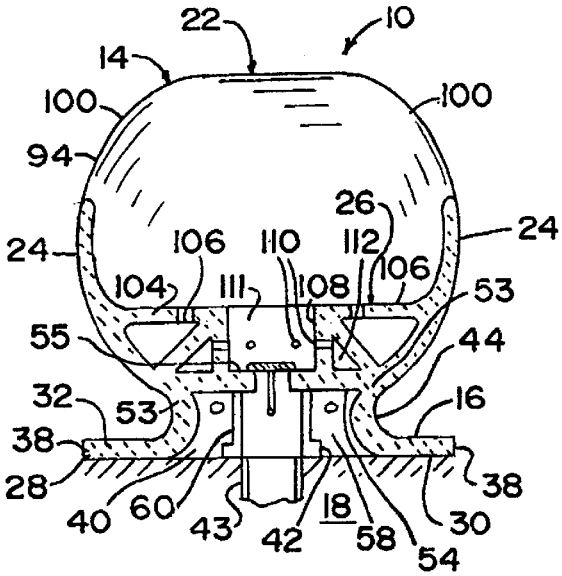
FIG. 5 is a diagrammatic cross sectional view taken along line 5—5 in FIG. 4.
Figure 3:
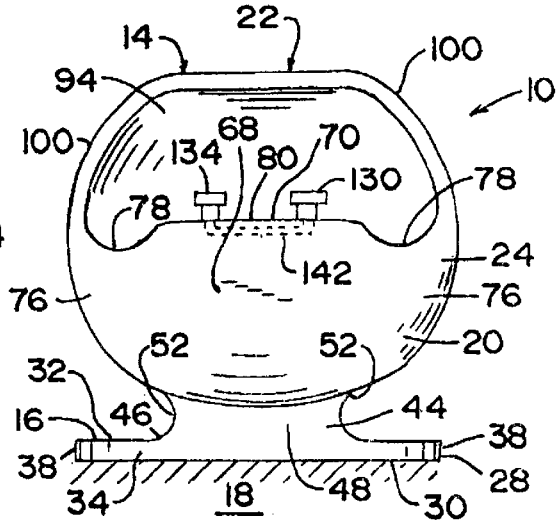
FIG. 3 is a diagrammatic front elevational view taken generally in the direction of arrow 3 in FIG. 2.
Figure 2:
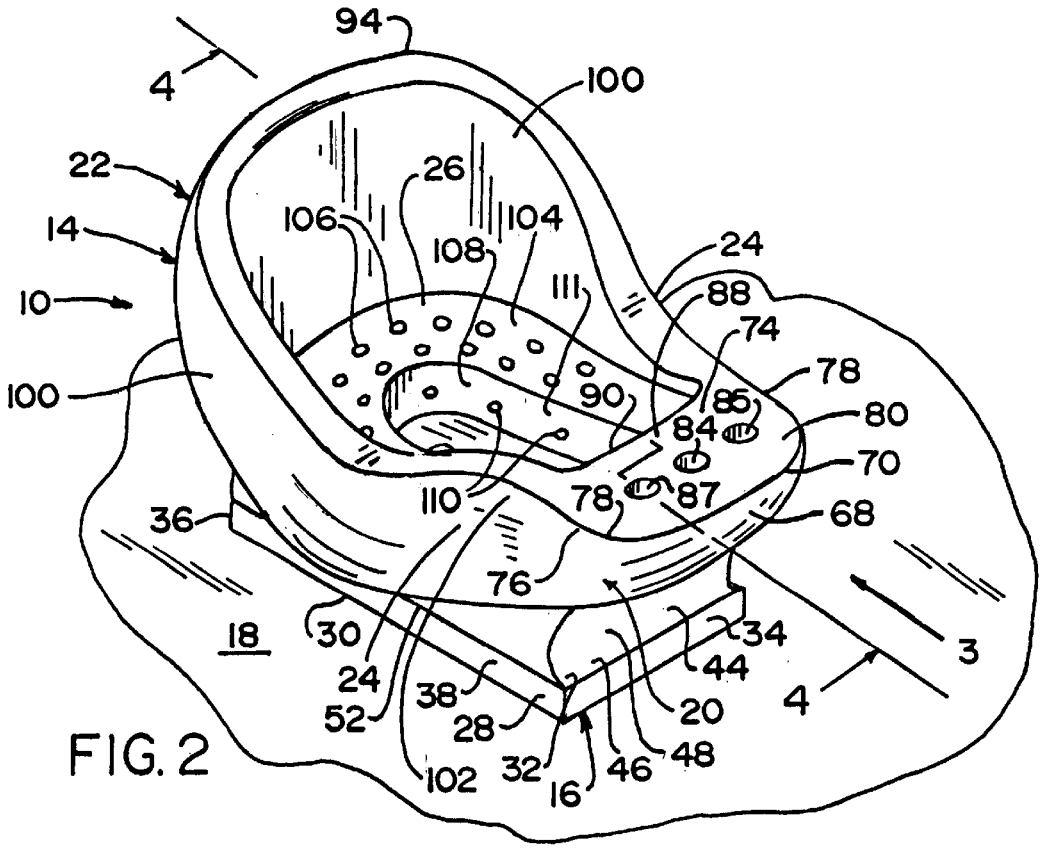
FIG. 2 is a diagrammatic perspective view of the area generally enclosed by the dotted curve identified by arrow 2 in FIG. 1 of the present invention.
Figure 4:
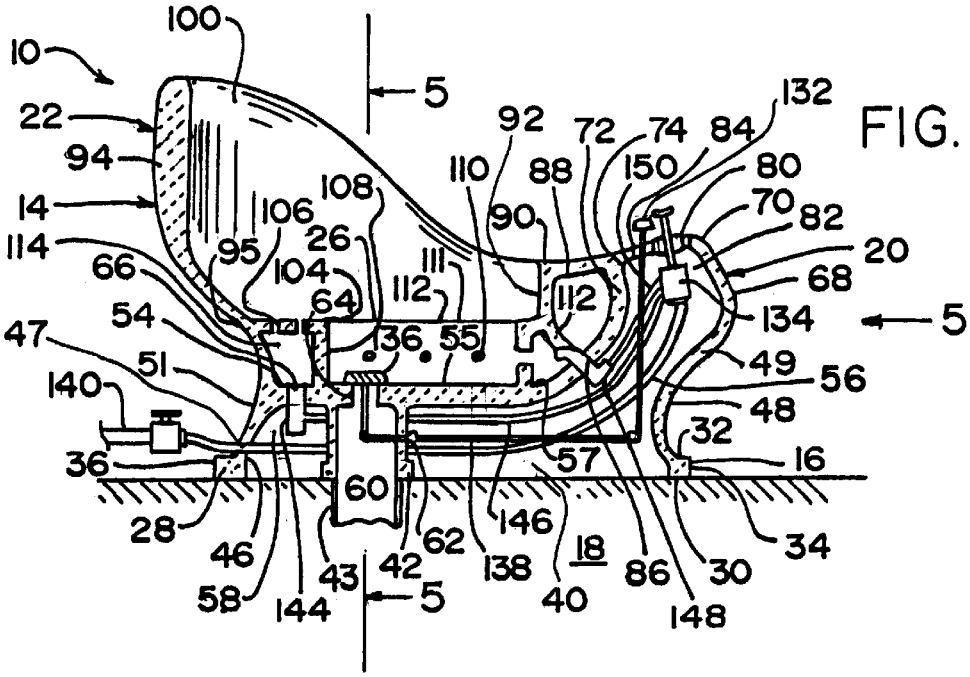
FIG. 4 is a diagrammatic cross sectional view taken along line 4—4 in FIG. 2.

10 combination hydrothermal bath and bidet of present invention for user 12
12 user
14 body for resting on floor 18
16 base portion of body 14 for resting on floor 18
18 floor
20 front portion of body 14
22 back portion of body 14 for leaning against by back 23 of user 12 when combination hydrothermal bath and bidet 10 is utilized as hydrothermal bath
23 back of user 12
24 pair of side portions of body 14 for straddling by legs of user 12
26 seat portion of body 14 for sitting upon by user 12 when combination hydrothermal bath and bidet 10 is utilized as hydrothermal bath
28 lower flange part of base portion 18 of body 14 for resting on, and sealing against, floor 18
30 lowermost surface of lower flange part 28 of base portion 18 of body 14 for resting on, and sealing against, floor 18
32 uppermost surface of lower flange part 28 of base portion 18 of body 14
34 front wall of lower flange part 28 of base portion 18 of body 14
36 rear wall of lower flange part 28 of base portion 18 of body 14
38 pair of side walls of lower flange part 28 of base portion 18 of body 14
40 first feed pipe chamber in lower flange part 28 of base portion 18 of body 14
42 drain pipe ring in lower flange part 28 of base portion 18 of body 14 for encircling waste pipe 43 passing vertically through first feed pipe chamber 40 in lower flange part 28 of base portion 18 of body 14
43 waste pipe passing vertically through first feed pipe chamber 40 in lower flange part 28 of base portion 18 of body 14
44 upper part of base portion 18 of body 14
46 lowermost surface of upper part 44 of base portion 18 of body 14
47 feed source throughbore through rear wall 50 of upper part 44 of base portion 18 of body 14
48 front wall of upper part 44 of base portion 18 of body 14
49 upper terminal end of front wall 48 of upper part 44 of base portion 18 of body 14
50 rear wall of upper part 44 of base portion 18 of body 14
51 upper terminal end of rear wall 50 of upper part 44 of base portion 18 of body 14
52 pair of side walls of upper part 44 of base portion 18 of body 14
53 upper terminal ends of pair of side walls 52 of upper part 44 of base portion 18 of body 14
54 top wall of upper part 44 of base portion 18 of body 14
55 uppermost surface of top wall 54 of upper part 44 of base portion 18 of body 14
56 front feed pipe passageway
57 forwardmost end of top wall 54 of upper part 44 of base portion 18 of body 14
58 second feed pipe chamber in upper part 44 of base portion 18 of body 14
60 drain tube in upper part 44 of base portion 18 of body 14
62 drain stopper control bore in drain tube 60 in upper part 44 of base portion 18 of body 14
64 drain throughbore through top wall 54 of upper part 44 of base portion 18 of body 14
66 bidet jet throughbore through top wall 54 of upper part 44 of base portion 18 of body 14
68 front wall of front portion 20 of body 14
70 uppermost edge of front wall 68 of front portion 20 of body 14
72 rear wall of front portion 20 of body 14
74 uppermost end of rear wall 72 of front portion 20 of body 14
76 pair of side walls of front portion 20 of body 14
78 upper terminal ends of pair of side walls 76 of front portion 20 of body 14
80 top wall of front portion 20 of body 14
82 third feed pipe chamber in front portion 20 of body 14
84 drain stopper control throughbore through top wall 80 of front portion 20 of body 14
85 diverter valve throughbore through top wall 80 of front portion 20 of body 14
86 bath jet throughbore through rear wall 72 of front portion 20 of body 14
87 mixer valve throughbore through top wall 80 of front portion 20 of body 14
88 extension of top wall 80 of front portion 20 of body 14
90 terminal edge of extension 88 of top wall 80 of front portion 20 of body 14
92 lip of extension 88 of top wall 80 of front portion 20 of body 14
94 rear wall of rear portion 22 of body 14 for allowing user 12 to lean back thereagainst while having upper legs 96 of user 12 rest incliningly forwardly upwardly on top wall 80 of front portion 20 of body 14 and buttocks 98 of user 12 to sit on seat portion 26 of body 14, with rearward downward slope of top wall 80 of front portion 20 of body 14 facilitating resting of buttocks 98 of user 12 on seat portion 26 of body 14 by tilting upper legs 96 of user 12 rearwardly downwardly
95 transition point of rear wall 94 of rear portion 22 of body 14

96 upper legs of user 12
98 buttocks of user 12
100 pair of side walls of rear portion 22 of body 14
102 concave areas in pair of side walls 100 of rear portion 22 of body 14 for allowing legs 96 of user 12 to separate and pass over so as to expose user 12 to hydrothermal bath and straddle divert valve throughbore 85 and mixer valve throughbore 87 in top wall 80 of front portion 20 of body 14
104 top wall of seat portion 26 of body 14
106 plurality of bidet water ejecting throughbores 106 through top wall 104 of seat portion 26 of body 14
108 side wall of seat portion 26 of body 14
110 plurality of bath water ejecting throughbores through side wall 108 of seat portion 26 of body 14
111 central opening in seat portion 26 of body 14 for providing space for genitalia of user 12 when user 12 is male and combination hypothermal bath and bidet 10 is utilized as a bath
112 bath manifold contained in seat portion 26
114 bidet manifold contained in seat portion 26
130 diverter valve for selectively directing water to one of bath manifold 112 in seat portion of body 14 and bidet manifold 114 in seat portion 26 of body 14
132 drain stopper control
134 mixer valve for selectively determining amount of hot and cold water to be used
136 drain stopper
138 drain stopper linkage
140 pair of source feed pipes for supplying hot and cold water
142 connecting pipe for conducting water from mixer valve 134 to diverter valve 130
144 bidet jet
146 bidet jet connecting pipe
148 bath jet
150 bath jet connecting pipe

DETAILED DESCRIPTION OF THE PREFERRED EMBODIMENT

Referring now to the figures, in which like numerals indicate like parts, and particularly to FIG. 1, the combination hydrothermal bath and bidet of the present invention is shown generally at 10 being utilized as a hydrothermal bath for a user 12 sitting therein.

The configuration of the combination hydrothermal bath and bidet 10 can best be seen in FIGS. 1–5, and as such, will be discussed with reference thereto.

The combination hydrothermal bath and bidet 10 comprises a body 14 that has a base portion 16 for resting on a floor 18.

The body 14 further has a front portion 20 that extends upwardly from the base portion 16 thereof.

The body 14 further has a back portion 22 that extends upwardly from the base portion 16 thereof for leaning against by the back 23 of the user 12 when the combination hydrothermal bath and bidet 10 is utilized as a hydrothermal bath.

The body 14 further has a pair of side portions 24 that extend upwardly from the base portion 16 thereof and forwardly from the back portion 22 thereof to the front portion 20 thereof for straddling by the legs of the user 12.

The body 14 further has a seat portion 26 for sitting upon by the user 12 when the combination hydrothermal bath and bidet 10 is utilized as the hydrothermal bath, and which is bordered by the portion 16 thereof, the front portion 20 thereof, the back portion 22 thereof, and the pair of side portions 24 thereof.

The body 14 is one-piece and made of porcelain.

The base portion 16 comprises a lower flange part 26 for resting on, and sealing against, the floor 18.

The lower flange part 28 of the base portion 16 is rectangular-shaped, and has a lowermost surface 30 that is flat for resting on, and sealing against, the floor 18, an uppermost surface that is flat and disposed above, and parallel to, the lowermost surface 30 thereof, a front wall 34, a rear wall 36, and a pair of side walls 38.

The lower flange part 28 of the base portion 16 further has a first feed pipe chamber 40 that opens into the lowermost surface 30 thereof, extends laterally from inward of one side wall 38 thereof to inward of the other side wall 38 thereof, and longitudinally from the rear wall 36 thereof to the front wall 34 thereof.

The lower flange part 28 of the base portion 16 further has a drain pipe ring 42 for encircling a waste pipe 43 that passes vertically through the first feed pipe chamber 40 therein, and which is horizontally oriented, and disposed on the lowermost surface 30 thereof, in the first feed pipe chamber 40 therein, closer to the rear wall 36 thereof than the front wall 32 thereof, and midway between the pair of side walls 38 thereof.

The base portion 16 further comprises an upper part 44 that extends upwardly from, and communicates with the lower flange part 28 thereof.

The upper part 44 of the base portion 16 has a lowermost surface 46 that is coincident with the uppermost surface 32 of the lower flange part 28 of the base portion 16.

The upper part 44 of the base portion 16 further has a front wall 48 that extends concavingly upwardly from the front wall 34 of the lower flange part 28 of the base portion 16 and concavingly upwardly from the pair of side walls 38 of the lower flange part 28 of the base portion 16, respectively, to an upper terminal end 49.

The upper part 44 of the base portion 16 further has a rear wall 50 that extends inwardly incliningly upwardly from the rear wall 36 of the lower flange part 28 of the base portion 16 and concavingly upwardly from the pair of side walls 38 of the lower flange part 28 of the base portion 16, respectively, to an upper terminal end 51.

The rear wall 50 of the upper part 44 of the base portion 16 has a feed source throughbore 47 that extends horizontally therethrough.

The upper part 44 of the base portion 16 further has a pair of side walls 52 that extend forwardly from the rear wall 50 thereof to the front wall 48 thereof and concavingly upwardly from the pair of side walls 38 of the lower flange part 28 of the base portion 16, respectively, to upper terminal ends 53.

The upper part 44 of the base portion 16 further has a top wall 54 that is flat and disposed above, and parallel to, the lower flange part 28 of the base portion 16, and has an uppermost surface 55.

The top wall 54 of the upper part 44 of the base portion 16 extends longitudinally from the upper terminal end 51 of the rear wall 50 of the upper part 44 of the base portion 16 to a forward most end 57 thereof that is short of the upper terminal end 49 of the front wall 48 of the upper part 44 of the base portion 16 so as to define a front feed pipe passageway 56 therebetween, and laterally from the upper terminal end 53 of one side wall 44 of the upper part 44 of the base portion 16 to the upper terminal end 53 of the other side wall 44 of the upper part 44 of the base portion 16.

The upper part 44 of the base portion 16 further has a second feed pipe chamber 58 that opens into, and communicates with, the first feed pipe chamber 40 in the lower flange part 28 of the base portion 16, extends laterally from one side wall 44 thereof to the other side wall 44 thereof, longitudinally from the rear wall 50 thereof to the front wall 48 thereof, and upwardly to the top wall 54 thereof.

The upper part 44 of the base portion 16 further has a drain tube 60 that is vertically-oriented and depends from the top wall 54 thereof, through the second feed pipe chamber 58 therein, through the first feed pipe chamber 40 in the lower flange part. 28 of the base portion 16, and coaxially to, and communicates coaxially with, the drain pipe ring 42 in the lower flange part 28 of the base portion 16. The drain tube 60 of the upper part 44 of the base portion 18 has a drain stopper control bore 62 that extends horizontally through a side thereof that faces the front wall 48 of the upper part 44 of the base portion 16.

The top wall 54 of the upper part 44 of the base portion 16 has a drain throughbore 64 that extends vertically therethrough, and communicates coaxially with the drain tube 60 of the upper part 44 of the base portion 16.

The top wall 54 of the upper part 44 of the base portion 16 further has a bidet jet throughbore 66 that extends vertically therethrough, and is disposed slightly forwardly of the rear wall 50 of the upper part 44 of the base portion 16, and midway between the pair of side walls 52 of the upper part 44 of the base portion 16.

The front portion 20 of the body 14 has a front wall 68 that extends first concavingly upwardly and forwardly then convexingly upwardly and rearwardly from the front wall 48 of the upper part 44 of the base portion 16, to an uppermost edge 70.

The front portion 20 of the body 14 further has a rear wall 72 that extends concavingly upwardly from the forward most end 57 of the top wall 54 of the upper part 44 of the base portion 16, to an uppermost end 74.

The front portion 20 of the body 14 further has a pair of side walls 76 that extend forwardly from the rear wall 72 thereof, to the front wall 68 thereof, and convexingly upwardly from the pair of side walls 52 of the upper part 44 of the base portion 16, respectively, to upper terminal ends 78.

The front portion 20 of the body 14 further has a top wall 80 that is flat and extends longitudinally from the uppermost end 74 of the rear wall 72 thereof, inclingly upwardly to the uppermost edge 70 of the front wall 68 thereof, where it convexes, and laterally from the uppermost edge 70 of one side wall 76 thereof, to the uppermost edge 70 of the other side wall 44 thereof.

The front portion 20 of the body 14 further has a third feed pipe chamber 82 that opens into, and communicates with, the second feed pipe chamber 58 in the upper part 44 of the base portion 16 through the front feed pipe passageway 56, and extends laterally from one side wall 76 thereof to the other side wall 76 thereof, longitudinally from the rear wall 72 thereof to the front wall 68 thereof, and upwardly to the top wall 80 thereof.

The top wall 80 of the front portion 20 of the body 14 has a drain stopper control throughbore 84 that extend vertically therethrough, and is disposed midway between the pair of side walls 76 of the front portion 20, and midway between the front wall 68 of the front portion 20 and the rear wall 72 of the front portion 20.

The top wall 80 of the front portion 20 of the body 14 further has a diverter valve throughbore 85 that extends vertically therethrough, and is disposed midway between one side wall 76 of the front portion 20 of the body 14 and the drain stopper control throughbore 84 therein.

The top wall 80 of the front portion 20 of the body 14 further has a mixer valve throughbore 87 that extends vertically therethrough, and is disposed midway between the other side wall 76 of the front portion 20 of the body 14 and the drain stopper control throughbore 84 therein.

The rear wall 72 of the front portion 20 of the body 14 has a bath jet throughbore 86 that extends rearwardly upwardly inclingly therethrough, and is disposed just above the forward most end 57 of the top wall 54 of the upper part 44 of the base portion 16, and midway between the pair of side walls 76 of the front portion 20 of the body 14.

The top wall 80 of the front portion 20 of the body 14 further has an extension 88 that extends smoothly rearwardly therefrom, from the uppermost edge 74 of the rear wall 72 of the front portion 20 of the body 14, to a terminal edge 90, and laterally from one side wall 76 of the front portion 20, to the other side wall 76 of the front portion 20.

The extension 88 of the top wall 80 of the front portion 20 of the body 14 has a lip 92 that depends completely along the terminal edge 90 thereof, to the seat portion 26.

The rear portion 22 of the body 14 has a rear wall 94 that extends convexingly sidewardly for matching the back of the user 12, and first concavingly upwardly from the upper terminal end 51 of the rear wall 50 of the upper part 44 of the base portion 16, to a transition point 95, than convexingly upwardly, and finally straight upwardly to an elevation above the top wall 80 of the front portion 20 for allowing the user 12 to lean back thereagainst while having the upper legs 96 of the user 12 rest inclingly forwardly upwardly on the top wall 80 of the front portion 20 and buttocks 98 of the user 12 to sit on the seat portion 26, with rearward downward slope of the top wall 80 of the front portion 20 facilitating resting of the buttocks 98 of the user 12 on the seat portion 26 by tilting the upper legs 96 of the user 12 rearwardly downwardly.

The rear portion 22 of the body 14 further has a pair of side walls 100 that extend forwardly from the rear wall 94 thereof.

Each side portion 24 of the body 14 extends convexingly outwardly and upwardly from an associated side wall 52 of the upper part 44 of the base portion 16, and first forwardly outwardly and convexingly downwardly from an associated side wall 100 of the rear portion 22, then forwardly inwardly at a slight upward incline to an associated side wall 76 of the front portion 20 so as to provide concave areas 102 for allowing the legs 96 of the user 12 to separate and pass thereover so as to expose the user 12 to the hydrothermal bath and straddle the mixer valve throughbore 87 in the top wall 80 of the front portion 20 of the body 14 and the diverter valve throughbore 85 in the top wall 80 of the front portion 20 of the body 14.

The seat portion 26 has a top wall 104 that is flat, oval-shaped, and disposed parallel to, and above, the top wall 54 of the upper part 44 of the base portion 16, at an elevation of the transition point 95 of the rear wall 94 of the rear portion 22.

The top wall 104 of the seat portion 26 extends laterally from, and abuts completely against, one side portion 24, to, and abuts completely against, the other side portion 24, and longitudinally from, and abuts completely against, the rear wall 94 of the rear portion 22, to, and abuts completely against, the lip 92 of the extension 88 of the top wall 80 of the front portion 20.

The top wall 104 of the seat portion 26 has a plurality of bidet water ejecting throughbores 106 that extend vertically therethrough, and are spaced-apart evenly therealong.

The seat portion 26 further has a side wall 108 that is flat, oval-shaped, and depends from the top wall 104 thereof, inward of the rear portion 22, the pair of side portions 24, and the lip 92 of the extension 88 of the top wall 80 of the front portion 20, to the top wall 54 of the upper part 44 of the base portion 16.

The side wall 108 of the seat portion 26 has a plurality of bath water ejecting throughbores 110 that extend horizontally therethrough, and are spaced-apart evenly therealong.

The seat portion 26 has a central opening 111 that is defined by the side wall 108 thereof, and which depends from the top wall 104 thereof to the top wall 54 of the upper part 44 of the base portion 16 for providing space for the genitalia of the user 12 when the user 12 is a male and the combination hypothermal bath and bidet 10 is utilized as a bath.

The seat portion 26 contains a bath manifold 112 that fluidly communicates with the plurality of bath water ejecting throughbores 110 in the side wall 108 thereof.

The seat portion 26 further contains a bidet manifold 114 that fluidly communicates with the plurality of bidet water ejecting throughbores 106 in the top wall 104 thereof.

The combination hydrothermal bath and bidet 10 further comprises a diverter valve 130 for selectively directing the water to one of the bath manifold 112 in the seat portion and the bidet manifold 114 in the seat portion 26, and which is disposed in the diverter valve throughbore 85 in the top wall 80 of the front portion 20.

The combination hydrothermal bath and bidet 10 further comprises a drain stopper control 132 that is disposed in the drain stopper control throughbore 84 in the top wall 80 of the front portion 20.

The combination hydrothermal bath and bidet 10 further comprises a mixer valve 134 that is disposed in the mixer valve throughbore 87 in the top wall 80 of the front portion 20 for selectively determining amount of hot and cold water to be used.

The combination hydrothermal bath and bidet 10 further comprises a drain stopper 136 that is disk-shaped, overlies the uppermost surface 55 of the top wall 54 of the upper part 44 of base portion 16, and selectively closes the drain throughbore 64 in the top wall 54 of the upper part 44 of the base portion 16.

The combination hydrothermal bath and bidet 10 further comprises drain stopper linkage 138 that is operatively connected to, and depends vertically from, the drain stopper control 132, through the third feed pipe chamber 82 in the front portion 20, through the front feed pipe passageway 56, and into the second feed pipe chamber 58 in the upper part 44 of the base portion 16, then horizontally rearwardly through the second feed pipe chamber 58 in the upper part 44 of the base portion 16, and through the drain stopper control bore 62 in the drain tube 60 of the upper part 44 of the base portion 16, and finally vertically upwardly through the drain throughbore 64 in the top wall 54 of the upper part 44 of the base portion 16, to, and operatively connected to, the drain stopper 136 so as to allow the drain stopper control 132 to control the drain stopper 136.

The combination hydrothermal bath and bidet 10 further comprises a pair of source feed pipes 140 that are separate from each other, one being for cold water and the other being for hot water, and which extend through the feed source throughbore 47 in the rear wall 50 of the upper part 44 of the base portion 16, and horizontally forwardly through the second feed pipe chamber 58 in the upper part 44 of the base portion 16, then upwardly through the front feed pipe passageway 56, and into the third feed pipe chamber 82 in the front portion 20 where they are fluidly connected to the mixer valve 134 for supplying hot and cold water.

The combination hydrothermal bath and bidet 10 further comprises a connecting pipe 142 that extends horizontally in the third feed pipe chamber 82 in the front portion 20, and fluidly connects the mixer valve 134 and the diverter valve 130 together for conducting the water from the mixer valve 134 to the diverter valve 130.

The combination hydrothermal bath and bidet 10 further comprises a bidet jet 144 that extends upwardly through the bidet jet throughbore 66 in the top wall 54 of the upper part 44 of the base portion 16, and into the bidet manifold 114.

The combination hydrothermal bath and bidet 10 further comprises a bidet jet connecting pipe 146 that is fluidly connected to the bidet jet 144, and extends horizontally forwardly through the second feed pipe chamber 58 in the upper part 44 of the base portion 16, then upwardly through the front feed pipe passageway 56, and into the third feed pipe chamber 82 in the front portion 20 where it is fluidly connected to the diverter valve 130, and when the diverter valve 130 is set for bidet, conducts the water to the bidet jet 144.

The combination hydrothermal bath and bidet 10 further comprises a bath jet 148 that extends rearwardly through the bath jet throughbore 86 in the rear wall 72 of the front portion 20, and into the bath manifold 112.

The combination hydrothermal bath and bidet 10 further comprises a bath jet connecting pipe 150 that is fluidly connected to the bath jet 148, and extends upwardly through the front feed pipe passageway 56, and into the third feed pipe chamber 82 in the front portion 20 where it is fluidly connected to the diverter valve 130, and when the diverter valve 130 is set for bath, conducts the water to the bath jet 148.

It will be understood that each of the elements described above, or two or more together, may also find a useful application in other types of constructions differing from the types described above.

While the invention has been illustrated and described as embodied in a combination hydrothermal bath and bidet, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A combination hydrothermal bath and bidet, comprising a body having:

a) a base portion for resting on a floor;

b) a front portion extending upwardly from said base portion thereof;

c) a back portion extending upwardly from said base portion thereof for leaning against by the back of a user when said combination hydrothermal bath and bidet is utilized as a hydrothermal bath;

d) a pair of side portions extending upwardly from said base portion thereof and forwardly from said back portion thereof to said front portion thereof for straddling by the legs of the user; and e) a horizontal seat portion for supporting the buttocks of the user in a sitting position when said combination hydrothermal bath and bidet is utilized as said hydrothermal bath, and being bordered by said base portion thereof, said front portion thereof, said back portion thereof, and said pair of side portions thereof, wherein the seat portion comprises a plurality of bidet water ejecting throughbores.

2. The combination as defined in claim 1, wherein said body is one-piece and made of porcelain.

3. The combination as defined in claim 1, wherein said base portion comprises a lower flange part for resting on, and sealing against, the floor.

4. The combination as defined in claim 3, wherein said lower flange part of said base portion is rectangular-shaped, and has:

a) a lowermost surface that is flat for resting on, and sealing against, the floor;

b) an uppermost surface that is flat and disposed above, and parallel to, said lowermost surface thereof;

c) a front wall;

d) a rear wall; and e) a pair of side walls.

5. The combination as defined in claim 4, wherein said lower flange part of said base portion further has a first feed pipe chamber that opens into said lowermost surface thereof, extends laterally from inward of one side wall thereof to inward of the other side wall thereof, and longitudinally from said rear wall thereof to said front wall thereof.

6. The combination as defined in claim 5, wherein said lower flange part of said base portion further has a drain pipe ring for encircling a waste pipe that passes vertically through said first feed pipe chamber therein, and which is horizontally oriented, and disposed on said lowermost surface thereof, in said first feed pipe chamber therein, closer to said rear wall thereof than said front wall thereof, and midway between said pair of side walls thereof.

7. The combination as defined in claim 6, wherein said base portion further comprises an upper part that extends upwardly from, and communicates with, said lower flange part thereof.

8. The combination as defined in claim 7, wherein said upper part of said base portion has a lowermost surface that is coincident with said uppermost surface of said lower flange part thereof.

9. The combination as defined in claim 7, wherein said upper part of said base portion further has a front wall that extends concavingly upwardly from said front wall of said lower flange part of said base portion and concavingly upwardly from said pair of side walls of said lower flange part of said base portion, respectively, to an upper terminal end.

10. The combination as defined in claim 9, wherein said upper part of said base portion further has a rear wall that extends inwardly incliningly upwardly from said rear wall of said lower flange part of said base portion and concavingly upwardly from said pair of side walls of said lower flange part of said base portion, respectively, to an upper terminal end.

11. The combination as defined in claim 10, wherein said upper part of said base portion further has a pair of side walls that extend forwardly from said rear wall thereof to said front wall thereof and concavingly upwardly from said pair of side walls of said lower flange part of said base portion, respectively, to upper terminal ends.

12. The combination as defined in claim 11, wherein said upper part of said base portion further has a top wall that is flat and disposed above, and parallel to, said lower flange part of said base portion, and has an uppermost surface.

13. The combination as defined in claim 12, wherein said top wall of said upper part of said base portion extends longitudinally from said upper terminal end of said rear wall of said upper part of said base portion to a forward most end thereof that is short of said upper terminal end of said front wall of said upper part of said base portion so as to define a front feed pipe passageway therebetween, and laterally from said upper terminal end of one side wall of said upper part of said base portion to said upper terminal end of the other side wall of said upper part of said base portion.

14. The combination as defined in claim 13, wherein said upper part of said base portion further has a second feed pipe chamber that opens into, and communicates with, said first feed pipe chamber in said lower flange part of said base portion, extends laterally from one side wall thereof to the other side wall thereof, longitudinally from said rear wall thereof to said front wall thereof, and upwardly to said top wall thereof.

15. The combination as defined in claim 14, wherein said upper part of said base portion further has a drain tube that is vertically-oriented and depends from said top wall thereof, through said second feed pipe chamber therein, through said first feed pipe chamber in said lower flange part of said base portion, and coaxially to, and communicates coaxially with, said drain pipe ring in said lower flange part of said base portion.

16. The combination as defined in claim 15, wherein said drain tube of said upper part of said base portion has a drain stopper control bore that extends horizontally through a side thereof that faces said front wall of said upper part of said base portion.

17. The combination as defined in claim 16, wherein said top wall of said upper part of said base portion has a drain throughbore that extends vertically therethrough, and communicates coaxially with said drain tube of said upper part of said base portion.

18. The combination as defined in claim 17, wherein said top wall of said upper part of said base portion further has a bidet jet throughbore that extends vertically therethrough, and is disposed slightly forwardly of said rear wall of said upper part of said base portion, and midway between said pair of side walls of said upper part of said base portion.

19. The combination as defined in claim 18, wherein said front portion of said body has a front wall that extends first concavingly upwardly and forwardly then convexingly upwardly and rearwardly from said front wall of said upper part of said base portion, to an uppermost edge.

20. The combination as defined in claim 19, wherein said front portion of said body further has a rear wall that extends concavingly upwardly from said forward most end of said top wall of said upper part of said base portion, to an uppermost end.

21. The combination as defined in claim 20, wherein said front portion of said body further has a pair of side walls that extend forwardly from said rear wall thereof, to said front wall thereof, and convexingly upwardly from said pair of side walls of said upper part of said base portion, respectively, to upper terminal ends.

22. The combination as defined in claim 21, wherein said front portion of said body further has a top wall that is flat and extends longitudinally from said uppermost end of said rear wall thereof, inclingly upwardly to said uppermost edge of said front wall thereof, where it convexes, and laterally from said uppermost edge of one side wall thereof, to said uppermost edge of the other side wall thereof.

23. The combination as defined in claim 22, wherein said front portion of said body further has a third feed pipe chamber that opens into, and communicates with, said second feed pipe chamber in said upper part of said base portion, through said front feed pipe passageway, and extends laterally from one side wall thereof to the other side wall thereof, longitudinally from said rear wall thereof to said front wall thereof, and upwardly to said top wall thereof.

24. The combination as defined in claim 23, wherein said top wall of said front portion of said body has a drain stopper control throughbore that extend vertically therethrough, and is disposed midway between said pair of side walls of aid front portion, and midway between said front wall of said front portion and said rear wall of said front portion.

25. The combination as defined in claim 24, wherein said top wall of said front portion of said body further has a diverter valve throughbore that extends vertically therethrough, and is disposed midway between one side wall of said front portion of said body and said drain stopper control throughbore therein.

26. The combination as defined in claim 25, wherein said top wall of said front portion of said body further has a mixer valve throughbore that extends vertically therethrough, and is disposed midway between the other side wall of said front portion of said body and said drain stopper control throughbore therein.

27. The combination as defined in claim 26, wherein said rear wall of said front portion of said body has a bath jet throughbore that extends rearwardly upwardly inclingly therethrough, and is disposed just above said forward most end of said top wall of said upper part of said base portion, and midway between said pair of side walls of said front portion of said body.

28. The combination as defined in claim 27, wherein said top wall of said front portion of said body further has an extension that extends smoothly rearwardly therefrom, from said uppermost edge of said rear wall of said front portion of said body, to a terminal edge thereof, and laterally from one side wall of said front portion, to the other side wall of said front portion.

29. The combination as defined in claim 28, wherein said extension of said top wall of said front portion of said body has a lip that depends completely along said terminal edge thereof, to said seat portion.

30. The combination as defined in claim 29, wherein said rear portion of said body has a rear wall that extends convexingly sidewardly for matching the back of the user, and first concavingly upwardly from said upper terminal end of said rear wall of said upper part of said base portion, than convexingly upwardly, and finally straight upwardly to an elevation above said top wall of said front portion for allowing the user to lean back thereagainst while having the upper legs of the user rest inclingly forwardly upwardly on said top wall of said front portion and the buttocks of the user to sit on said seat portion, with rearward downward slope of said top wall of said front portion facilitating resting of the buttocks of the user on said seat portion by tilting the upper legs of the user rearwardly downwardly.

31. The combination as defined in claim 30, wherein said rear portion of said body further has a pair of side walls that extend forwardly from said rear wall thereof.

32. The combination as defined in claim 31, wherein each side portion of said body extends convexingly outwardly and upwardly from an associated side wall of said upper part of said base portion, and first forwardly outwardly and convexingly downwardly from an associated side wall of said rear portion, then forwardly inwardly at a slight upward incline to an associated side wall of said front portion so as to provide concave areas for allowing the legs of the user to separate and pass thereover so as to expose the user to said hydrothermal bath and straddle said diverter valve throughbore and said mixer valve throughbore in said top wall of said front portion of said body.

33. The combination as defined in claim 30, wherein said seat portion has a top wall that is flat, oval-shaped, and disposed parallel to, and above, said top wall of said upper part of said base portion, at an elevation of said transition point of said rear wall of said rear portion.

34. The combination as defined in claim 33, wherein said top wall of said seat portion extends laterally from, and abuts completely against, one side portion, to, and abuts completely against, the other side portion, and longitudinally from, and abuts completely against, said rear wall of said rear portion, to, and abuts completely against, said lip of said extension of said top wall of said front portion.

35. The combination as defined in claim 33, wherein said top wall of said seat portion has said plurality of bidet water ejecting throughbores that extend vertically therethrough, and are spaced-apart evenly therealong.

36. The combination as defined in claim 35, wherein said seat portion further has a side wall that is flat, oval-shaped, and depends from said top wall thereof, inward of said rear portion, said pair of side portions, and said lip of said extension of said top wall of said front portion, to said top wall of said upper part of said base portion.

37. The combination as defined in claim 36, wherein said side wall of said seat portion has a plurality of bath water ejecting throughbores that extend horizontally therethrough, and are spaced-apart evenly therealong.

38. The combination as defined in claim 36, wherein said seat portion has a central opening that is defined by said side wall thereof, and which depends from said top wall thereof to said top wall of the upper part of the base portion for providing space for the genitalia of the user when the user is a male and said combination hypothermal bath and bidet is utilized as a bath.

39. The combination as defined in claim 37, wherein said seat portion contains a bath manifold that fluidly communicates with said plurality of bath water ejecting throughbores in said side wall thereof.

40. The combination as defined in claim 35, wherein said seat portion further contains a bidet manifold that fluidly communicates with said plurality of bidet water ejecting throughbores in said top wall thereof.

41. The combination as defined in claim 40; further comprising a diverter valve for selectively directing the water to one of said bath manifold in said seat portion and said bidet manifold in said seat portion, and being disposed in said diverter valve throughbore in said top wall of said front portion.

42. The combination as defined in claim 41; further comprising a mixer valve disposed in said mixer valve throughbore in said top wall of said front portion for selectively determining amount of hot and cold water to be used.

43. The combination as defined in claim 42; further comprising a pair of source feed pipes being separate from each other, one being for cold water and the other being for hot water, and extending through a feed source throughbore in said rear wall of said upper part of said base portion, and horizontally forwardly through said second feed pipe chamber in said upper part of said base portion, then upwardly through said front feed pipe passageway, and into said third feed pipe chamber in said front portion where they are fluidly connected to said mixer valve for supplying hot and cold water.

44. The combination as defined in claim 42; further comprising a connecting pipe extending horizontally in said third feed pipe chamber in said front portion, and fluidly connecting said mixer valve and said diverter valve together for conducting the water from said mixer valve to said diverter valve.

45. The combination as defined in claim 41; further comprising a bidet jet extending upwardly through said bidet jet throughbore in said top wall of said upper part of said base portion, and into said bidet manifold.

46. The combination as defined in claim 45; further comprising a bidet jet connecting pipe fluidly connecting to said bidet jet, and extending horizontally forwardly through said second feed pipe chamber in said upper part of said base portion, the upwardly through said front feed pipe passageway, and into said third feed pipe chamber in said front portion where it is fluidly connected to said diverter valve, and when said diverter valve is set for bidet, conducts the water to said bidet jet.

47. The combination as defined in claim 41; further comprising a bath jet extending rearwardly through said bath jet throughbore in said rear wall of said front portion, and into said bath manifold.

48. The combination as defined in claim 47; further comprising a bath jet connecting pipe fluidly connecting to said bath jet, and extending upwardly through said front feed pipe passageway, and into said third feed pipe chamber in said front portion where it is fluidly connected to said diverter valve, and when said diverter valve is set for bath, conducts the water to said bath jet.

49. The combination as defined in claim 24; further comprising a drain stopper control disposed in said drain stopper control throughbore in said top wall of said front portion.

50. The combination as defined in claim 49; further comprising a drain stopper being disk-shaped, overlying said uppermost surface of said top wall of said upper part of base portion, and selectively closing said drain throughbore in said top wall of said upper part of said base portion.

51. The combination as defined in claim 50; further comprising drain stopper linkage operatively connecting to, and depending vertically from, said drain stopper control, through said third feed pipe chamber in said front portion, through said front feed pipe passageway, and into said second feed pipe chamber in said upper part of said base portion, then horizontally rearwardly through said second feed pipe chamber in said upper part of said base portion, and through said drain stopper control bore in said drain tube of said upper part of said base portion, and finally vertically upwardly through said drain throughbore in said top wall of said upper part of said base portion, to, and operatively connecting to, said drain stopper so as to allow said drain stopper control to control said drain stopper.

* * * * *